US005344733A

United States Patent [19]

Suzuki et al.

[11] Patent Number: 5,344,733

[45] Date of Patent: Sep. 6, 1994

[54] ELECTROPHOTOGRAPHIC RECEPTOR

[75] Inventors: Shinichi Suzuki; Yasuyuki Shigematsu; Takashi Kojima; Hiroe Kizaki; akira Itsubo, all of Ami, Japan

[73] Assignee: Mitsubishi Petrochemical Co., Ltd., Tokyo, Japan

[21] Appl. No.: 971,480

[22] Filed: Nov. 4, 1992

[30] Foreign Application Priority Data

Nov. 7, 1991 [JP] Japan ..... 3-291321
Apr. 15, 1992 [JP] Japan ..... 4-095465

[51] Int. Cl.[5] ..... G03G 5/147; G03G 5/047

[52] U.S. Cl. ..... 430/58; 430/59; 430/66; 430/67; 430/96

[58] Field of Search ..... 430/58, 66, 67, 96

[56] References Cited

U.S. PATENT DOCUMENTS 4,734,347 3/1988 Endo et al. ..... 430/58
4,772,526 9/1988 Kan et al. ..... 430/58
4,863,823 9/1989 Hiro et al. ..... 430/58
5,096,793 3/1992 Osawa et al. ..... 430/58
5,213,927 5/1993 Kan et al. ..... 430/66

FOREIGN PATENT DOCUMENTS 63-271270 11/1988 Japan ..... 430/66
3-009367 1/1991 Japan ..... 430/66

*Primary Examiner*—Christopher Rodee
*Attorney, Agent, or Firm*—Oblon, Spivak, McClelland, Maier & Neustadt

[57] ABSTRACT

Disclosed is an electrophotographic receptor provided with an overcoat layer comprising a cured fluororesin and a nitrogen-containing compound selected from the group consisting of an aromatic amine antioxidant and a charge transport substance on the surface of a photosensitive layer containing a charge generating substance.

7 Claims, 5 Drawing Sheets

ELECTROPHOTOGRAPHIC RECEPTOR

BACKGROUND OF THE INVENTION

The present invention relates to an electrophotographic receptor, and more particularly, to a photoreceptor suitable for improving printing service life.

Although primarily inorganic materials such as selenium, zinc oxide, cadmium sulfate and titanium oxide were used for photoconductive materials used in electrophotographic receptors of the prior art, these materials were unsatisfactory in terms of sensitivity, heat resistance and printing durability, and also had problems with respect to toxicity. On the other hand, electrophotographic receptors having a photosensitive layer consisting primarily of an organic photoconductive compound are generally superior to inorganic types in terms of having less toxicity and greater transparency, flexibility and freedom of shape.

In the case of using an electrophotographic printer employing the Carlson method, printing is performed by means of processes consisting of electrification, exposure, development, transfer, separation and fixation. However, electrification, exposure, development and transfer are normally performed on a photoreceptor. Consequently, although organic photoreceptors have the remarkable advantages described above, they have the shortcoming of wearing down quickly in the form of reduced charge potential and changes in sensitivity accompanying repetition of the processes of electrification and exposure. This is due to deterioration of the photoreceptor surface due to mechanical factors such as abrasion, and chemical factors such as being subjected to an oxidizing atmosphere such as ozone produced during corona electrical charging in processes using the Carlson method.

Although a method using an antioxidant is proposed in Japanese Unexamined Patent Publication No. 122444/1982 as a means of preventing surface deterioration caused by ozone and so on, this method is not satisfactory. In photoreceptors wherein charge generating substances are present in the outermost layer, it becomes easy for ozone and so on to be adsorbed by the charge generating substance thereby making measures for preventing surface deterioration increasingly difficult.

SUMMARY OF THE INVENTION

The object of the present invention is to prevent oxidation by oxidizing gas such as ozone of the photosensitive layer of an electrophotographic receptor, and particularly, the charge generating substance contained in that photosensitive layer, stabilize the photoreceptor and lengthen its service life, as well as provide an electrophotographic receptor that prevents filming by improving the wear resistance during printing.

The present invention relates to an electrophotographic receptor provided with an overcoat layer containing a nitrogen-containing substance selected from the group consisting of an aromatic amine antioxidant and a charge transport substance and a cured fluororesin on the surface of a photosensitive layer containing a charge generating substance.

DESCRIPTION OF THE PREFERRED EMBODIMENT

Figure 1:
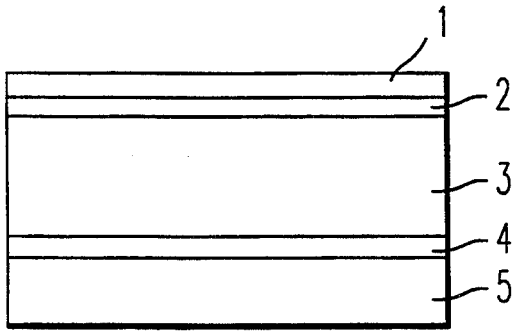
FIG. 1 is a schematic drawing of the layer structure of the electrophotographic receptor of the present invention.

In the following, the present invention is explained in more detail.

The charge generating substance used in the present invention can include a pyrylium type dye, a thiopyrylium type dye, a cyanine type dye, a phthalocyanine type pigment, an anthanthrone pigment, a dibenzpyrenequinone pigment, a pyranetrone pigment, a trisazo pigment, a disazo pigment, an azo pigment, an indigo dye, a quinacridone type pigment, an asymmetric quinocyanine, a quinocyanine pigment, zinc oxide, cadmium oxide.

The photosensitive layer used in the present invention is formed by dispersing a charge generating substance into a binder resin.

As the binder resin, a widely used insulative resin or an organic photoconductive polymer can be selected.

The film thickness of the photosensitive layer is 0.1 to 30 μm at a drying.

The photosensitive layer can be formed by coating the composition dispersed the above charge generating substance into the binder resin on a subbing layer and a conductive layer by a known method followed by drying.

The electrophotographic receptor is provided with an overcoat layer containing a nitrogen-containing compound selected from the group consisting of an aromatic amine antioxidant and a charge transport substance, and a cured fluororesin on the photosensitive layer.

The curable fluororesin used in the present invention is a resin having a fluorine atom and containing a functional group which is reactive with a crosslinking agent, and generally, a copolymer of an ethylenic unsaturated monomer having a fluorine atom and of other ethylenic unsaturated monomers is used.

As an ethylenic unsaturated monomer having a fluorine atom, there may be included, a fluorine-containing olefin such as tetrafluoroethylene, trifluoroethylene, vinylidene fluoride, vinyl fluoride, monochlorotrifluoroethylene, 1-chloro-2,2-difluoroethylene, 1,1-dichloro-2,2-difluoroethylene, vinylidene chlorofluoride, hexafluoropropene, 3,3,3,2-tetrafluoropropene, trifluoromethylethylene, 2-fluoropropene, 2-chloro-1,1,3,3,3-pentafluoropropene, 1,1,2-trichloro-3,3,3-trifluoropropene, perfluoro-1-butene, perfluoro-1-pentene, perfluorobutylethylene, perfluoro-1-heptene, perfluoro-1-nonene, perfluorohexylethylene, perfluorooctylethylene, perfluorodecylethylene, perfluorododecylethylene, etc; a fluoroalkyl (meth) acrylate such as trifluoroethyl (meth)acrylate, tetrafluoropropyl (meth)acrylate, hexafluorobutyl (meth)acrylate, octafluoropentyl (meth)acrylate, heptadecafluorononyl (meth) acrylate, heptadecafluorodecyl (meth)acrylate; alkyl fluoride vinyl ether (the part or all of hydrogen atoms of alkyl vinyl ether are replaced by a fluorine atom); a vinyl ester of a fluoroaliphatic acid (the part or all of hydrogen atoms of a vinyl ester of an aliphatic acid are replaced by a fluorine atom. Among of them, a fluorine-containing olefin is preferred.

Other ethylenic unsaturated monomers can include a vinyl ether group, an allyl ether group, a vinyl ester group, an allyl ester group, an olefin group, etc. Among of them, the vinyl ether group and the vinyl ester group are preferred. The ethylenic unsaturated monomer containing a functional group, for example, a hydroxyl group, a carboxyl group, an amino group, a glycidyl group which is reactive with a crosslinking agent mentioned after is more preferable. The ethylenic unsaturated monomer having a hydroxyl group as a functional group is most preferable and can include, for example, a hydroxyalkylvinyl ether, a hydroxyalkylallyl ether, allyl alcohol, hydroxyalkyl (meth)acrylate, acrylic acid, methacrylic acid. For the purpose of adjusting a physical property of the curable fluororesin or for the purpose of introducing the above functional group to the copolymer, other monomers can be copolymerized with the above ethylenic unsaturated monomer.

As a commercially available product of the curable fluororesin used in the present invention, "Cefral Coat" (trade name; produced by Central glass Co. , Ltd.) and "Lumiflon" (trade name; produced by Asahi glass Co. Ltd.) are preferably used.

Other monomers, for example, glycidylvinyl ether, ethylene, propylene, iso-butylene, vinyl chloride, vinylidene chloride, ethylvinyl ether, iso-butylvinyl ether, n-butylvinyl ether, etc. can be added to the cured fluororesin used in the present invention.

In the curable fluororesin used in the present invention, the ethylenic unsaturated monomer component having a fluorine atom is preferably 40 to 60 mole % in the total amount of the copolymer.

The overcoat layer used in the present invention contains the above curable fluororesin and the nitrogen-containing compound, and a crosslinking agent used for the crosslinking-curing of the curing fluororesin.

As a crosslinking agent, the compound having two or more active group such as butylated melamine, methylated melamine, polyisocyanate, glyoxal, etc. is used.

The amounts of the crosslinking agent to be used are different due to the curing condition, the amount and the kind of the functional group, however, the crosslinking agent is used at the amount that the functional group is equivalent or excess.

As an aromatic amine antioxidant used in the present invention, there can be used, N-phenyl-N'-isopropyl-p-phenylenediamine, N,N-diethyl-p-phenylenediamine, N-phenyl-N'-ethyl-2-methyl-p-phenylenediamine, N-ethyl-N-hydroxyethyl-p-phenylenediamine, alkylated diphenylamine, N,N'-diphenyl-p-phenylenediamine, N,N'-diallyl-p-phenylenediamine, N-phenyl-1,3-dimethylbutyl-p-phenylenediamine, 4,4'-dioctyl-diphenylamine, 6-ethoxy-2,2,4-trimethyl-1,2-dihydroquinoline, 2,2,4-trimethyl-1,2-dihydroquinoline, N-phenyl-$\beta$-naphthylamine, N,N'-di-2-naphthyl-p-phenylenediamine. The compound other than the above, if the amine replaced by the aromatic ring is contained in a molecule, may be used. The above antioxidant is used singly or in combination.

As a charge transport substance used in the present invention is a nitrogen-containing compound having an aromatic ring in the molecule thereof and has superior transport ability of positive electron-hole. Specific examples of a charge transport substances are oxa-diazole derivatives, such as 2,5-bis(p-diethylaminophenyl)oxadiazole; pyrazoline derivatives such as 1-phenyl-3-(p-diethylaminostyryl)-5-(p-diethylaminophenyl)pyrazoline; hydrazone derivatives such as p-diethylaminobenzaldehyde-N,N-diphenylhydrazone and p-diethylaminobenzaldehyde-N-$\alpha$-naphthyl-N-phenylhydrazone; polyarylalkane derivatives such as 1,1-bis(4-N,N-diethylamino-2-methylphenyl)heptane and 1,1,2,2-tetrakis(4-N,N-diethylamino-2-methylphenyl)ethane; oxazole derivatives such as 2-(p-diethylaminostyryl)-6-diethylaminobenzoxazole; thiazole derivatives such as 2-(p-diethylaminostyryl)-6-diethylaminobenzthiazole; triarylamine derivatives such as triphenylamine; carbazole derivatives such as N-ethylcarbazole and N-isopropylcarbazole; amino-substituted chalcone derivatives; stilben derivatives; phenylenediamine derivatives; triazole derivatives; and imidazole derivatives.

The above charge transport substance is used singly or in combination. Further, the aromatic amine antioxidant and the charge transport substance may be used in combination.

The content of the nitrogen-containing compound is 0.1–50% by weight against the curable fluororesin in the overcoat layer, preferably, 0.1–25% by weight, more preferably, 1–10% by weight. When the content of the nitrogen-containing compound is excess 50% by weight, since the mechanical property of the overcoat layer is often decreased, the above content is not preferable.

The film thickness of the overcoat layer is within a range of 0.01–10 $\mu$m, and preferably 0.5–5 $\mu$m.

The overcoat layer can be formed by dissolving the above curable fluororesin, the nitrogen-containing compound and the crosslinking agent into a solvent, and by coating the obtained solution on the photosensitive layer, and by drying it followed by curing.

In the overcoat layer used in the electrophotographic receptor of the present invention, the charge generating substance can be incorporated, so that the image having a contrast can be obtained by decreasing the retention potential of the surface of the photosensitive layer.

The charge generating substance used in the overcoat layer may be same or different with the charge generating substance used in the photosensitive layer and can include a pyrylium type dye, a thiopyrylium type dye, a cyanine type dye, a phthalocyanine type pigment, an anthoanthorone pigment, a dibenzpyrenequinone pigment, a pyranetrone pigment, a trisazo pigment, a disazo pigment, an azo pigment, an indigo dye, a quinacridone type pigment, an asymmetric quinocyanine, a quinocyanine pigment, zinc oxide, cadmium oxide.

The content of the charge generating substance is not more than 30% by weight, preferably 0.1–15% by weight, more preferably 1–10% by weight. When the content of the charge generating substance is too much, since the surface deterioration preventing effect as the overcoat layer is often decreased, the content is not preferable.

Although there is no limitation on the type of solvent as long as it can dissolve both the curable fluororesin and the nitrogen-containing compound, examples of those solvents that can be used include alcohols such as methanol, ethanol and isopropanol; ketones such as acetone, methylethyl ketone and cyclohexanone; amides such as N,N-dimethylformamide and N,N-dimethylacetoamide; sulfoxides such as dimethylsulfoxide; ethers such as tetrahydrofuran, dioxane and ethyleneglycol monomethyl ether; esters such as methyl acetate and ethyl acetate; aliphatic halogenated hydrocarbons such as chloroform, methylene chloride, dichloroethylene, carbon tetrachloride and trichloroethylene; and aromatics such as benzene, toluene, xylene, ligroin, monochlorobenzene and dichlorobenzene.

Coating can be performed using coating methods such as immersion coating, spray coating, spin coating, bead coating, wire coating, blade coating, roller coating or curtain coating.

Drying following coating is preferably performed using a method wherein drying is performed by heating after drying to the touch at room temperature. Heat dry curing can be performed over a time range of 1 minute to 6 hours at a temperature of 30° C.–300° C., either while stationary or in the presence of blown air or under an inactivated gas or under the vacuum. Further, the multiple dry curing can be performed at the two or more heating conditions.

Figure 2:
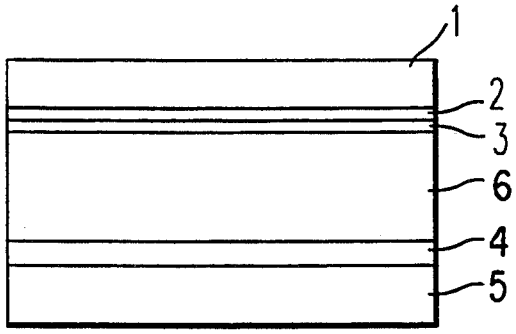
FIG. 2 is a schematic drawing of the layer structure of the electrophotographic receptor of an another embodiment of the present invention.

In the electrophotographic receptor of the present invention, in addition to the above photosensitive layer 3 and the overcoat layer 1, a charge transport layer 6 can be provided as shown in FIG. 1 an FIG. 2.

The conductive layer 5 is provided below the above photosensitive layer 3 or the charge transport layer 6.

As the conductive layer 5, there can be used, a conductive polymer; a conductive compound such as indium oxide; the substance in which a conductive metal foil such as aluminum, palladium and gold is coated, vapor-deposited or laminated on the substrate such as a paper, a plastic and a film; the substance that a carbon, a metal powder, etc. is dispersed into an integrity resin; a metal plate or a metal drum.

The charge transport layer 6 can be provided in the intermediate portion between the above photosensitive layer 3 and the conductive layer 5 and the photosensitive characteristic such as a sensitivity is improved.

As the charge transport layer 6, there can be used, the layer comprising a photoconductive polymer; and the substance that the charge transport substance is dispersed into a binder resin or is subjected to solid-solution formation.

As the charge transport substance, there can be included, a polymer having a heterocyclic ring compound in the side chain, for example, poly-N-vinylcarbazole, and a nitrogen-containing compound having an aromatic ring in the molecule thereof, for example, a triazole derivative, an oxaziazole derivative, an imidazole derivative, a pyrazoline derivative, a polyarylalkane derivative, a phenylenediamine derivative, a hydrazone derivative, an amino-substituted chalcone derivative, triarylamine derivative, a carbazole derivative, a stilben derivative, an oxazole derivative, and a thiazole derivative.

As the binder resin, a widely used insulative resin or a photoconductive polymer can be chosen.

In order to improve the adhesiveness and the photosensitive characteristic, an intermediate layer 2 and a subbing layer 4 can be provided, if necessary.

Further, in the electrophotographic receptor having the layer composition as shown in FIG. 1, the film thickness of the photosensitive layer is preferably 5–30 μm at a drying, and in the layer composition as shown in FIG. 2, the film thickness of the photosensitive layer is preferably 0.1–20 μm at a drying.

The following provides a detailed explanation of examples of the present invention. However, said examples do not limit the mode in which the present invention is carried out in anny way whatsoever.

EXAMPLE 1

0.53 g of a copper phthalocyanine dye were placed in a glass container with 9.87 g of polycarbonate resin (Yupilon E-2000, trade name, produced by Mitsubishi Gas Chemical Co., Ltd.), 3.0 g of cyclohexanone and 20 g of glass beads. These were then stirred and dispersed for 4 hours using a paint mixer to obtain the photoreceptor coating liquid. This coating liquid was coated onto an aluminum sheet having thickness of 90 μm so that the film thickness when dry was 16 μm. This was then dried for 1 hour at 80° C. to produce the photosensitive layer.

Next, a coating liquid consisting of 2 g of fluororesin (Cefral Coat A-101B, trade name, produced by Central Glass Co., Ltd.), 0.12 g of polyisocyanate (Coronate HX, trade name, produced by Nippon Polyurethane Industries, Ltd.), 0.04 mg of dibutyltinlaurate, 9 ml of cyclohexanone and 0.061 g of N-phenyl-N'-isopropyl-p-phenylenediamine was prepared. The obtained coating liquid was coated onto the surface of the above-mentioned photosensitive layer so that the film thickness when dry was 1 μm. The electrophotographic receptor was then obtained by drying and curing for 8 hours at 45° C.

Figure 3:
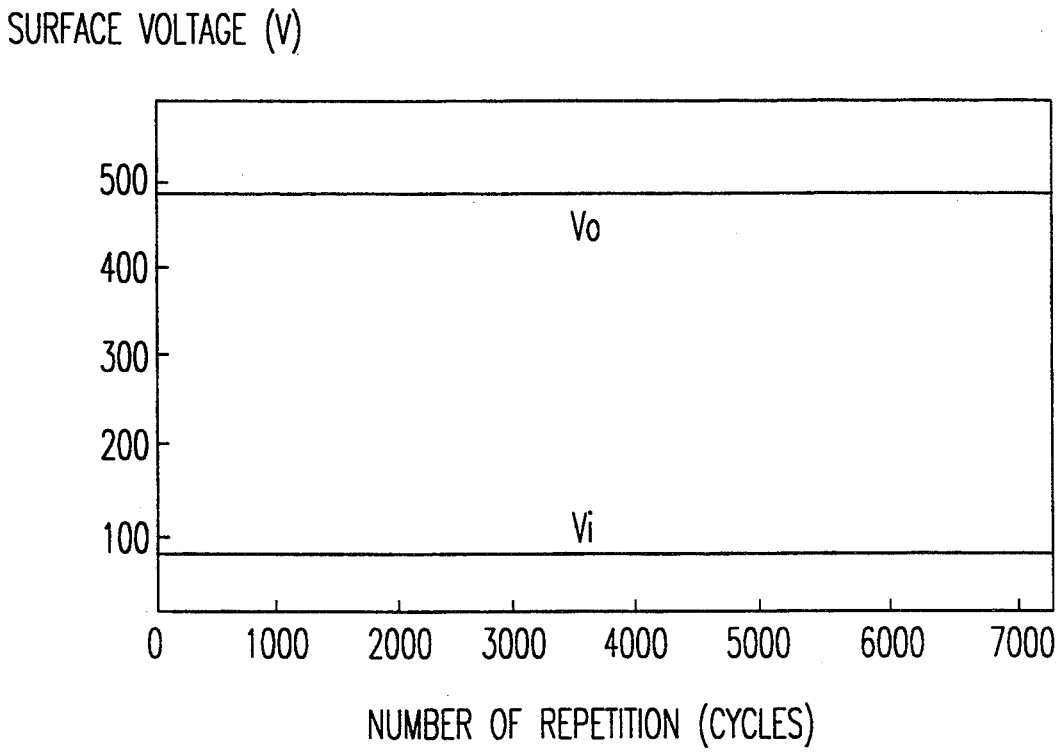
FIG. 3 is a graph of the electrostatic properties of the electrophotographic receptor of Example 1.

Evaluation of an Electrostatic Characteristic of the Electrophotographic Receptor Repeated evaluations were performed with respect to electrophotographic characteristics of the photoreceptors obtained above using a photoreceptor evaluation system (Synthia 55, Gentech Co., Ltd.). The evaluation process was performed by repeating (1) positive electrification, (2) exposure, (3) negative electrification and (4) erasure exposure. Positive electrification was performed by corona electrical charging of +6 KV, exposure was performed by exposing to light at 780 nm and 20 $\mu w/cm^2$, negative electrification was performed by corona electrical charging of −5.3 KV, and erasure exposure was performed by irradiating with light from a tungsten lamp at 200 lux. The results are shown in FIG. 3.

EXAMPLE 2

Figure 4:
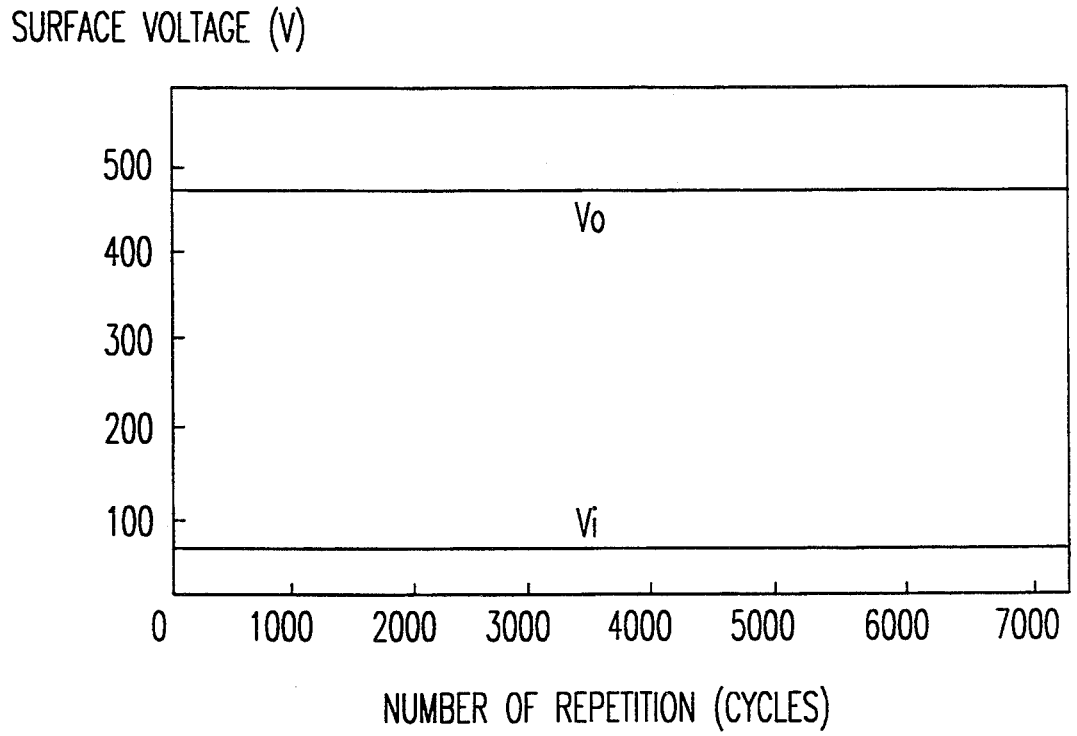
FIG. 4 is a graph of the electrostatic properties of the electrophotographic receptor of Example 2.

An electrophotographic receptor was obtained according to a method similar to that of Example 1, except for using 2,2,4-trimethyl-1,2-dihydroquinoline instead of N-phenyl-N' -isopropyl-p-phenylenediamine used in Example 1. The electrostatic characteristic of the obtained photoreceptor was evaluated in the same manner as in Example 1. The results are shown in FIG. 4.

EXAMPLE 3

The photosensitive layer was produced in the same manner as in Example 1.

Figure 5:
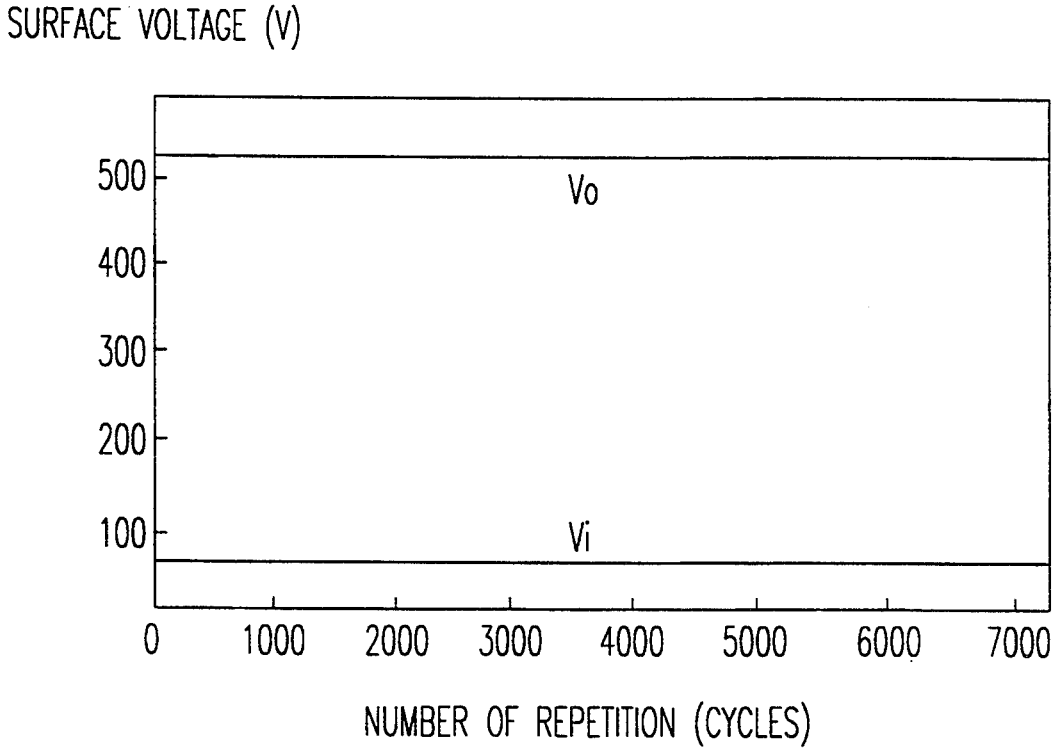
FIG. 5 is a graph of the electrostatic properties of the electrophotographic receptor of Example 3.

Next, a coating liquid consisting of 2 g of fluororesin (Sefural Coat A-101B, trade name, produced by Central Glass Co., Ltd.), 0.12 g of polyisocyanate (Coronate HX, trade name, produced by Nippon Polyurethane Industries, Ltd.), 0.04 mg of dibutyltinlaurate, 9 ml of cyclohexanone and 0.061 g of p-diethylaminobenzaldehyde diphenylhydrazone was prepared. The obtained coating liquid was coated onto the surface of the above-mentioned photosensitive layer so that the film thickness when dry was 1 μm. The electrophotographic receptor was then obtained by drying and curing for 8 hours at 45° C. The electrostatic characteristic of the obtained photoreceptor was evaluated in the same manner as in Example 1. The results are shown in FIG. 5.

EXAMPLE 4

Figure 6:
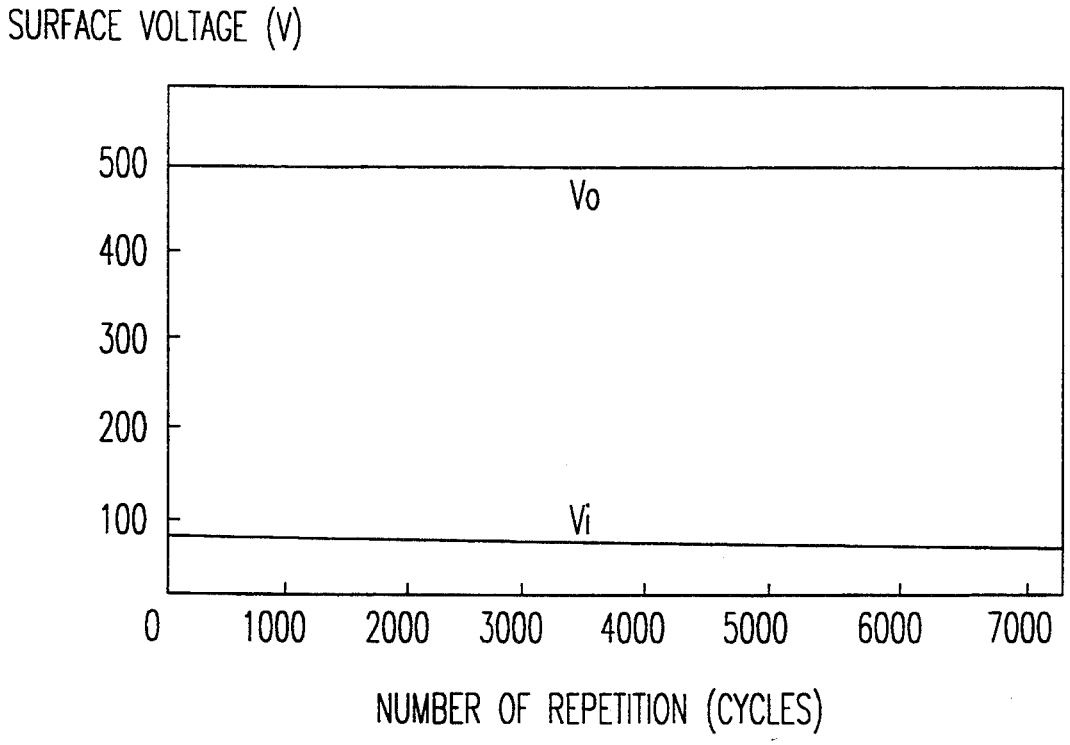
FIG. 6 is a graph of the electrostatic properties of the electrophotographic receptor of Example 4.

An electrophotographic receptor was obtained according to a method similar to that of example 3, except for using 2,5-bis(p-diethylaminophenyl)-1,3,4-oxadiazole instead of p-diethylaminobenzaldehydodiphenylhydrazone used in Example 3. The electrostatic characteristic of the obtained photoreceptor was evaluated in the same manner as in Example 1. The results are shown in FIG. 6.

COMPARATIVE EXAMPLE 1

An electrophotographic receptor was obtained in the same manner as in Example 1 except for forming the overcoating layer by using 1.22 g of polycarbonate instead of the curable fluororesin, the curing agent and dibutyltinlaurate, and by using dichloroethane instead of cyclohexanone.

Figure 7:
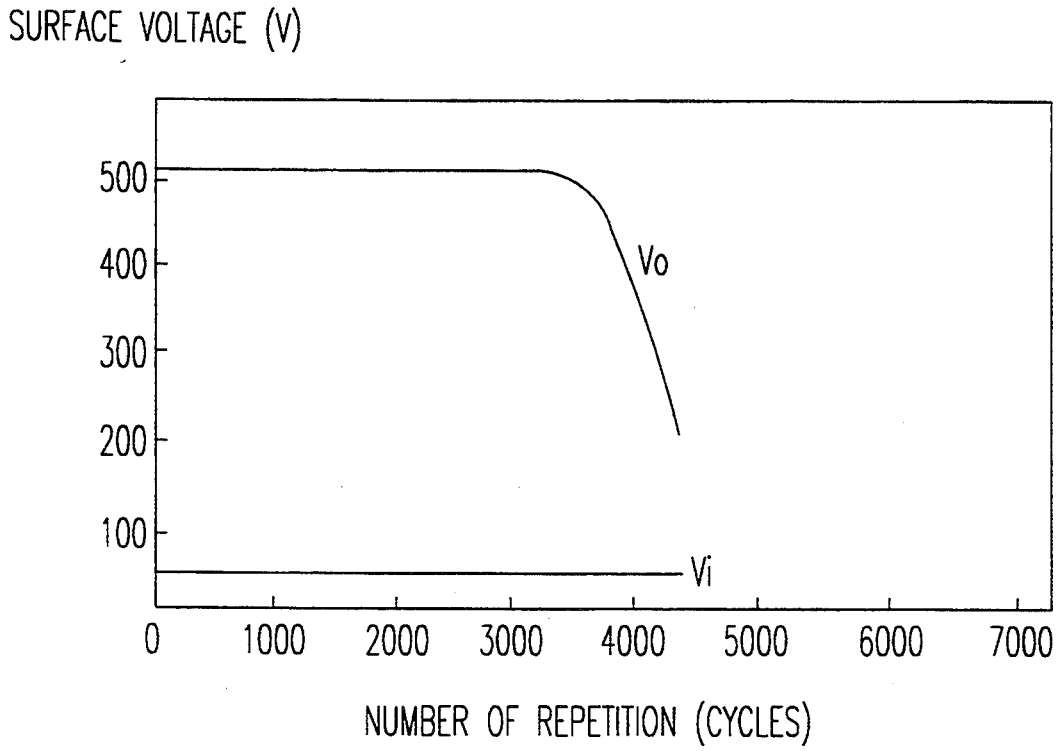
FIG. 7 is a graph of the electrostatic properties of the electrophotographic receptor of Comparative Example 1.

The electrostatic characteristic of the obtained photoreceptor was evaluated in the same manner as in Example 1. The results are shown in FIG. 7.

COMPARATIVE EXAMPLE 2

An electrophotographic receptor was obtained in the same manner as in Example 1 except that N-phenyl-N'-isopropyl-p-phenylenediamine was not used.

Figure 8:
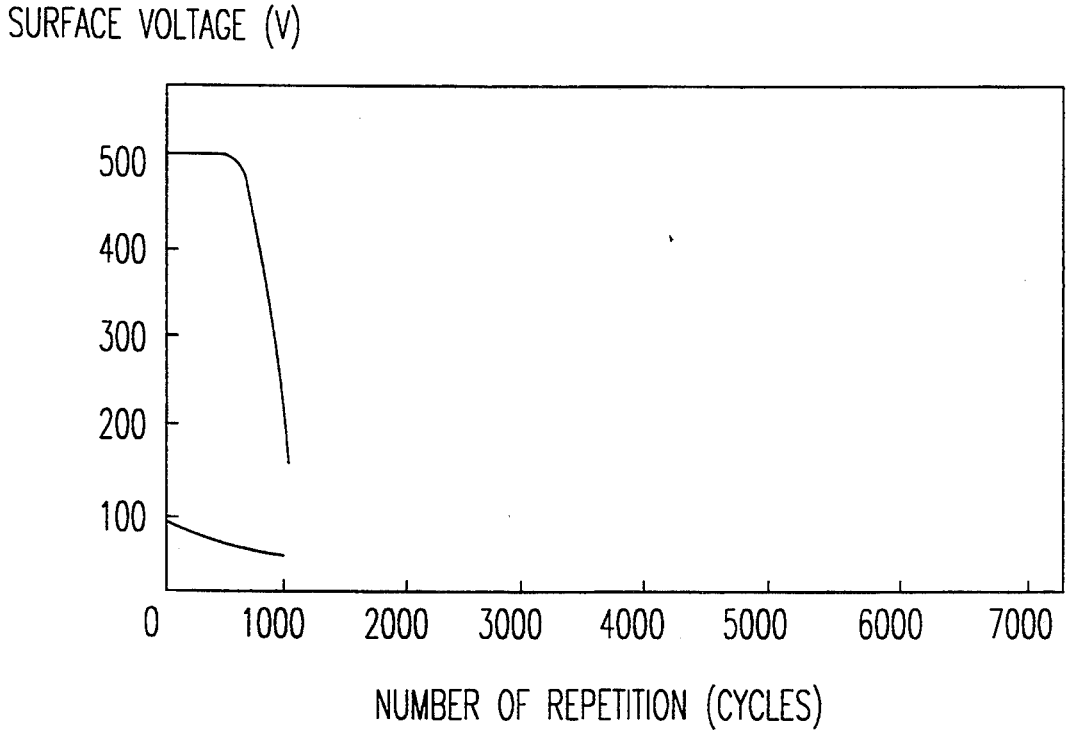
FIG. 8 is a graph of the electrostatic properties of the electrophotographic receptor of Comparative Example 2.

The electrostatic characteristic of the obtained photoreceptor was evaluated in the same manner as in Example 1. The results are shown in FIG. 8.

COMPARATIVE EXAMPLE 3

An electrophotographic receptor was prepared in the same manner as in Example 1 except that the overcoat layer was not formed on the surface of the photosensitive layer.

Figure 9:
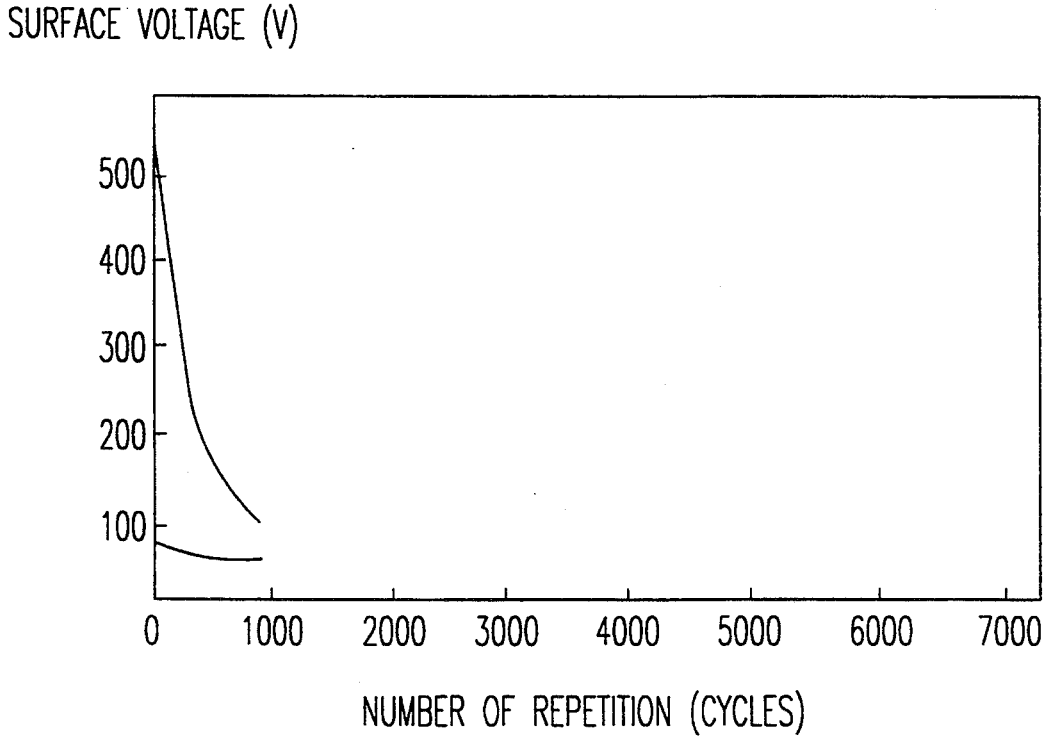
FIG. 9 is a graph of the electrostatic properties of the electrophotographic receptor of Comparative Example 3.

The electrostatic characteristic of the obtained photoreceptor was evaluated in the same manner as in Example 1. The results are shown in FIG. 9.

EXAMPLE 5

The electrophotographic receptor was obtained in the same manner as in Example 4 except for using the coating solution to which 0.061 g of X type non-metal phthalocyanine pigment were added instead of the coating solution used in Example 4 and was obtained by stirring and dispersing for 4 hours using a paint mixer adding 15 g of glass beads.

EXAMPLE 6

The electrophotographic receptor was obtained in the same manner as in Example 5 except for using α type copper phthalocyanine instead of X type non-metal phthalocyanine used in Example 5.

EXAMPLE 7

The electrophotographic receptor was obtained in the same manner as in Example 5 except for using 0.061 g of N-phenyl-N'-isopropyl-p-phenylenediamine instead of 2,5-bis(4-diethylaminophenyl)-1,3,4-oxaziazole used in Example 5.

Concerning the electrophotographic receptor obtained in Examples 4 to 7 and in Comparative Example 1, the electrophotographic characteristics were evaluated.

Repeated evaluation was performed according to a method similar to that of Example 1. The surface voltage immediately after positive electrification (Vo) and the surface voltage after 2 seconds following exposure (Vi) were measured for the number of times of the processes. The number (N) until the surface voltage immediately after electrification varies at 10% or more was recorded as a repetition characteristic.

Figure 10:
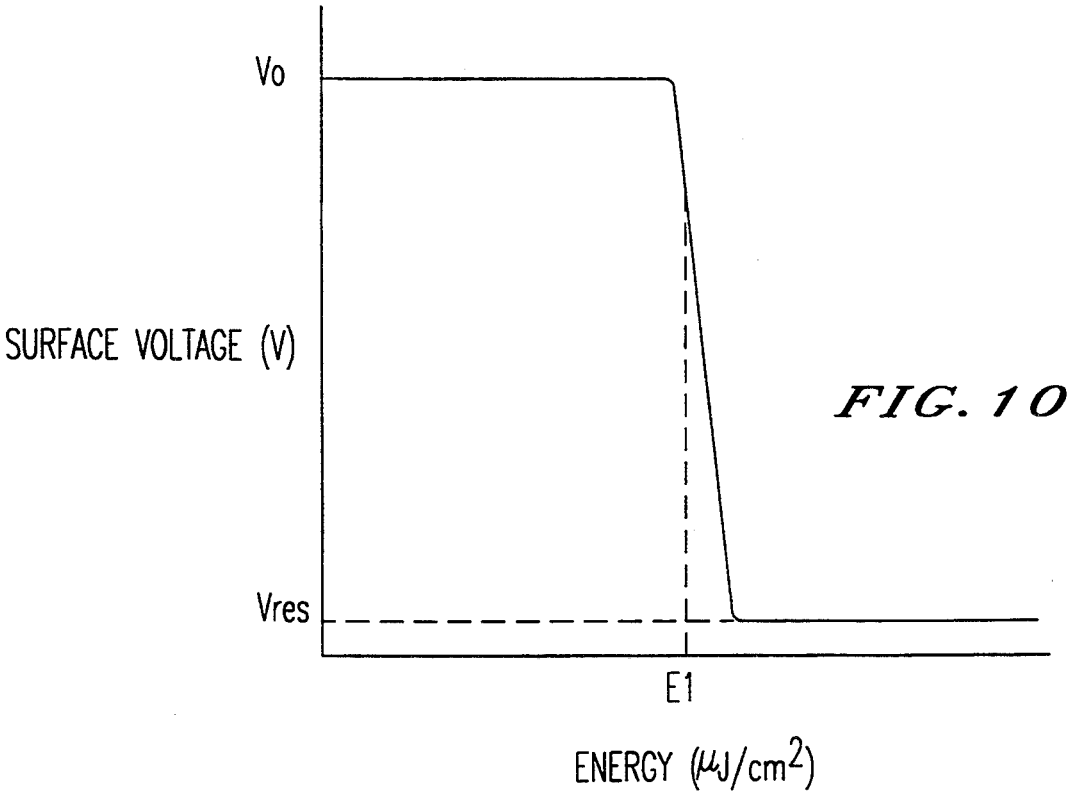
FIG. 10 is a graph of the photosensitive characteristic of the photosensitive layer obtained by plotting the surface potential after irradiation for a constant time against each light energy.

The photosensitive layer was corona-electrified with the voltage of +6.0 kV and the monochlomatic light of 780 nm having the different light intensity was irradiated to the electrified photosensitive layer respectively. The light damping time curve to each irradiation light (surface potential vs irradiation time) was measured respectively and the surface potential at a constant time irradiation (0.5 second) obtained from the above curve was plotted against each light energy (referring to FIG. 10). The light energy which can maintain the surface potential to the about same degree of the initial electrification was regarded as a sensitivity $E_1$ (μJ/cm). Further, after the surface potential is rapidly damped, it is extremely loosely damped. The surface potential at the time when the loose damping begins was demanded as a retention potential. The results are shown in the following Table.

| | $E_1$ (μJ/cm) | N (number) | Retention potential (V) |
|---|---|---|---|
| Example 4 | 2.5 | 10000 | 130 |
| Example 5 | 2.5 | 9500 | 31 |
| Example 6 | 2.8 | 9000 | 29 |
| Example 7 | 2.7 | 9800 | 32 |
| Comparative Example 1 | 2.6 | 3500 | 130 |

As is clear from these results, the electrophotographic receptor of the present invention demonstrates a longer service life and higher stability having considerably improved repetition characteristics than the comparative examples. Furthermore, when the charge generating substance is incorporated in the over coat layer, the image having a contrast can be obtained by decreasing the retention potential of the surface.

The electrophotographic receptor of the present invention greatly suppresses deterioration of photoreceptor characteristics in oxidative environments containing ozone and so on by providing an overcoat on the surface of the photosensitive layer. In addition, the electrophotographic receptor of the present invention also is effective in preventing filming as a result of having improved wear resistance. Thus, it can be used as an electrophotographic receptor having both stability and a long service life in a broad range of applications including copiers and laser printers.

We claim:

1. An electrophotographic receptor having an overcoat layer on the surface of a photosensitive layer containing a charge generating substance, said overcoat layer having a thickness of 0.01–10 μm, comprising a fluororesin cured by using a melamine compound or an isocyanate compound as a cross-linking agent, a charge generating substance, and a charge transport substance selected from nitrogen-containing compounds ring in the molecule thereof.

2. The electrophotographic receptor of claim 1, wherein said photosensitive layer is a mono layer.

3. The electrophotographic receptor of claim 1, wherein said charge generating substance contained in the photosensitive layer contains a phthalocyanine pigment as a main component.

4. The electrophotographic receptor of claim 1, wherein the photosensitive layer is a double layer in which the charge generating layer is provided on the charge transport layer.

5. The electrophotographic receptor of claim 1, wherein the content of the charge transport substance is 0.1 to 50 parts by weight per 100 parts by weight of the cured fluororesin.

6. The electrophotographic receptor of claim 1, wherein the cured fluororesin is a copolymer of an ethylenic unsaturated monomer having a fluorine atom and of another ethylenic unsaturated monomer.

7. The electrophotographic receptor of claim 1, wherein said charge generating substance contained in the overcoat layer contains a phthalocyanine pigment as a main component.

* * * * *